United States Patent [19]

Takano

[11] Patent Number: 4,603,260

[45] Date of Patent: Jul. 29, 1986

[54] COMPOSITE MATERIAL FOR STORAGE OF RADIATION IMAGE

[75] Inventor: Masao Takano, Kaisei, Japan

[73] Assignee: Fuji Photo Film Co., Ltd., Kaisei, Japan

[21] Appl. No.: 514,844

[22] Filed: Jul. 18, 1983

[30] Foreign Application Priority Data

Jul. 21, 1982 [JP] Japan ..... 57-127232

[51] Int. Cl.[4] ..... H05B 33/00

[52] U.S. Cl. ..... 250/484.1; 206/454; 428/68; 428/913

[58] Field of Search ..... 430/139, 965, 966; 250/496.1, 488.1, 462.1, 484.1, 327.2, 485.1; 428/68, 913; 206/454, 455

[56] References Cited

U.S. PATENT DOCUMENTS

| | | | |
|---|---|---|---|
| 2,322,082 | 6/1943 | Wynd et al. | 430/966 |
| 2,887,379 | 5/1959 | Blake et al. | 430/139 |
| 3,238,859 | 3/1966 | Mauchly | 430/139 |
| 3,671,254 | 6/1972 | Dostes | 430/966 |
| 3,787,238 | 1/1974 | Juliano | 250/488.1 |
| 4,350,893 | 9/1982 | Takahashi et al. | 250/484.1 |
| 4,438,164 | 3/1984 | Pfeifer et al. | 206/454 |
| 4,491,736 | 1/1985 | Teraoka et al. | 250/484.1 |

*Primary Examiner*—Paul J. Thibodeau

*Attorney, Agent, or Firm*—Gerald J. Ferguson, Jr.; Michael P. Hoffman; James E. Bryan

[57] ABSTRACT

A composite material comprises a radiation image storage panel composed of a light-shielding substrate and a phosphor layer containing a stimulable phosphor and provided on the substrate, and a light-shielding sheet positioned on the surface on the phosphor layer side of the radiation image storage panel in a manner separable from the surface. The light-shielding sheet is made of a material interrupting stimulating rays which excite the stimulable phosphor, but permeable to a radiation passing through an object.

6 Claims, 4 Drawing Figures

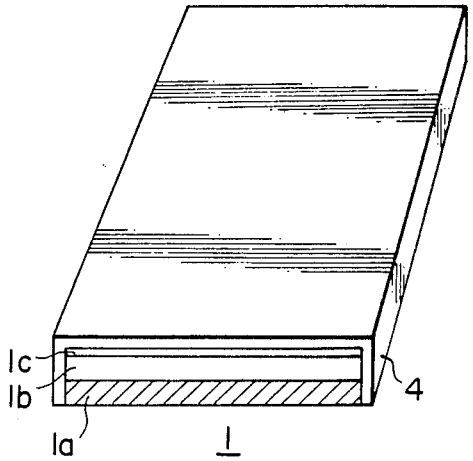
FIG.1
FIG.2
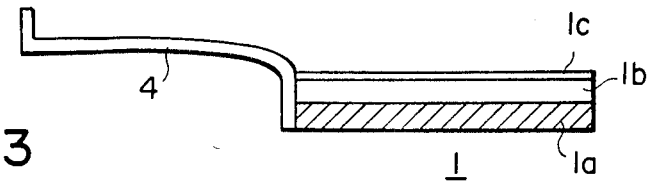
FIG.3
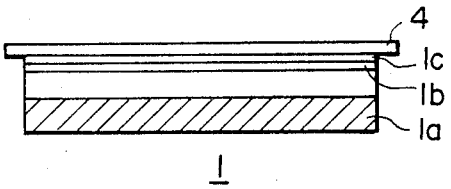
FIG.4
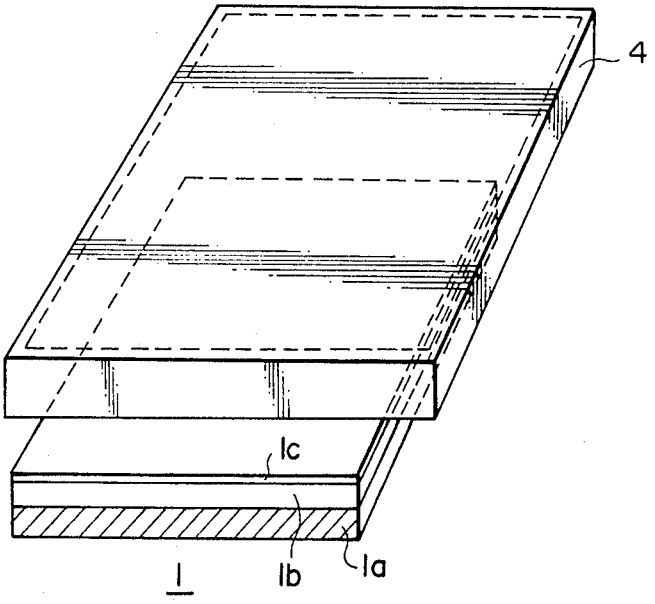

COMPOSITE MATERIAL FOR STORAGE OF RADIATION IMAGE

BACKGROUND OF THE INVENTION

1. Field of the Invention

This invention relates to a composite material for storage of a radiation image, which comprises a radiation image storage panel.

2. Description of the Prior Art

As is well known, there is widely used a method of radiography wherein an X-ray photographic film is exposed to a radiation passing through an object to record an X-ray transmission image of the object for viewing, particularly for diagnostic purposes. In the conventional radiography, intensifying screens are used together with the X-ray photographic film in order to increase the speed of the radiographic system. In general, the radiography is conducted by interleaving the X-ray photographic film between two intensifying screens, loading the obtained combination in a light-shielding cassette, and loading the cassette in an image recording stage.

However, in mammography, dental image recording or the like, it is impossible to use the cassette as described above. In such a case, therefore, a radiation image is recorded by inserting the X-ray photographic film and the intensifying screens in a light-shielding, bag-like holder. However, in this method, since the X-ray photographic film and the intensifying screens are simply inserted into the holder and not put into close contact with each other, the image quality of the obtained X-ray transmission image is deteriorated, and it is not possible to obtain an X-ray transmission image suitable for viewing, particularly for diagnostic purposes. This presents a very real problem particularly when the X-ray photographic film and the intensifying screens are bent according to the shape of the object in dental panoramic image recording from the outside of the mouth, or the like. In order to eliminate the problem due to loose contact of the X-ray photographic film with the intensifying screens, there has heretofore been used a method wherein the bag-like holder is evacuated to improve contact of the X-ray photographic film with the intensifying screens. However, it is very troublesome to evacuate the bag-like holder, and formation of the bag-like holder capable of being evacuated results in higher costs for image recording.

A novel method for recording and reproducing a radiation image without using the X-ray photographic film is disclosed, for example, in U.S. Pat. No. 4,239,968. In this radiation image recording and reproducing method, there is used a radiation image storage panel comprising a stimulable phosphor which emits light when stimulated by an electromagnetic wave selected from among visible light and infrared rays after exposure to a radiation. (The term "radiation" as used herein means electromagnetic wave or corpuscular radiation such as X-rays, $\alpha$-rays, $\beta$-rays, $\gamma$-rays, high energy neutron rays, cathode rays, vacuum ultraviolet rays, ultraviolet rays, or the like.) The method comprises the steps of (i) causing the stimulable phosphor of the panel to absorb the radiation energy corresponding to the amount of the radiation passing through an object, thereby to form a latent radiation image in the stimulable phosphor, (ii) scanning the panel with an electromagnetic wave such as visible light or infrared rays (hereinafter referred to as "stimulating rays") to sequentially release the radiation energy stored in the panel as light emission, and (iii) detecting the emitted light and converting it into an image.

The radiation image storage panel employed in the aforesaid method for recording and reproducing a radiation image has a phosphor layer comprising an appropriate binder and a stimulable phosphor dispersed therein. When the phosphor layer is self-supporting, the phosphor layer can by itself form the radiation image storage panel. In general, however, the phosphor layer is provided on an appropriate substrate to form the radiation image storage panel. Normally, a protective film for physically and chemically protecting the phosphor layer is provided on the phosphor layer on the side opposite to the substrate. Further, a prime-coating layer is sometimes formed between the phosphor layer and the substrate for the purpose of increasing contact therebetween, a light-reflecting layer is sometimes formed between the phosphor layer and the substrate to improve the sensitivity of the panel, or a light-absorbing layer is sometimes formed between the phosphor layer and the substrate to improve the sharpness of the image obtained by the panel. Further, to improve the sharpness of the image obtained by the panel, the phosphor layer is sometimes colored, or white particles are sometimes dispersed in the phosphor layer.

In the aforesaid method for recording and reproducing a radiation image, a radiation image is stored in the phosphor layer itself of the radiation image storage panel. Namely, the panel is not combined with an X-ray photographic film as in the case of the intensifying screens. Therefore, this method does not present the aforesaid problem due to loose contact of the X-ray photographic film with the intensifying screens. Accordingly, this method can provide a radiation image having high image quality even when image recording is conducted without using the cassette. However, since it is a property of the radiation image storage panel that the radiation energy stored in the phosphor layer is lost as light emission when exposed to stimulating rays, the phosphor layer of the panel should be shielded from light, as in the case of the conventional X-ray photographic film, between the image recording step and the image read-out step so that the phosphor layer will not be exposed to stimulating rays contained in natural light.

Accordingly, when the radiation image storage panel is used for image recording without using the cassette, the panel should be carefully handled, for example in a dark room, so that the phosphor layer of the panel will not be exposed to stimulating rays between the image recording and the image read-out.

SUMMARY OF THE INVENTION

The primary object of the present invention is to provide a composite material for storage of a radiation image, which can be easily handled even in a light room when image recording is conducted without using a cassette.

Another object of the present invention is to provide a composite material for storage of a radiation image, which is suitable for obtaining a radiation image having a high image quality.

When the substrate of the radiation image storage panel is not permeable to light, the sections of the phosphor layer of the panel that are exposed to natural light are the surface of the phosphor layer on the side opposite to the substrate, and the end faces of the phosphor layer. However, experiments conducted by the inventors revealed that, in order to make it possible to handle the radiation image storage panel even in a light room, it is generally sufficient in practice that only the surface of the phosphor layer constituting the major portion of the sections of the phosphor layer exposed to natural light be shielded from light. Thus, it was found that complete light shielding as in the case of the X-ray photographic film is not necessarily required.

Accordingly, in the present invention, a light-shielding sheet is provided on the surface (i.e. the surface of the protective film or the surface of the phosphor layer) of the radiation image storage panel comprising a light-shielding substrate in a manner separable from said surface, thereby making it possible to handle the panel even in a light room in the course between the image recording and the image read-out and to separate the light-shielding sheet from the surface of the panel and expose the surface of the panel to stimulating rays at the image read-out step. Namely, the composite material for storage of a radiation image in accordance with the present invention comprises:

(i) a radiation image storage panel comprising a light-shielding substrate and a phosphor layer containing a stimulable phosphor and provided on said substrate, and (ii) a light-shielding sheet positioned on the surface on the phosphor layer side of said radiation image storage panel in a manner separable from said surface.

As described above, in the present invention, the light-shielding sheet is positioned on the surface (i.e. the surface of the protective film or the surface of the phosphor layer) of the radiation image storage panel comprising the light-shielding substrate, and the surface of the phosphor layer constituting the major portion of the sections of the phosphor layer of the panel exposed to natural light is shielded from light. However, preferably, the end faces of the panel should also be shielded from light so that the phosphor layer is completely shielded from light. Shielding of the end faces of the panel from light may be effected by using a) the light-shielding sheet positioned on the surface on the phosphor layer side of the panel, or b) a light-shielding material other than the light-shielding sheet positioned on the phosphor layer side of the panel. In general, the end faces of the radiation image storage panel are covered and sealed with films of an appropriate resin (i.e. the end faces are provided with end face coverings) in order to improve the mechanical strength of the end faces. Therefore, as a preferred embodiment of the aforesaid method b) for shielding the end faces of the panel from light, the end faces may be covered with a light-shielding end face covering material, thereby to provide the end faces of the panel with the end face covering and, at the same time, to shield the end faces from light.

The term "light-shielding" as used herein means that at least the stimulating rays are shielded. Particularly, as for the light-shielding sheet positioned on the surface on the phosphor layer side of the panel, the term "light-shielding" means that the sheet shields against the stimulating rays but is permeable to the radiation image of an object formed by a radiation passing through the object.

In the present invention, since a radiation image is recorded in the phosphor layer itself of the radiation image storage panel (i.e. since no X-ray photographic film is used), the panel does not present the problem due to loose contact of the X-ray photographic film and the intensifying screens, which occurs when the X-ray photographic film and the intensifying screens are used in combination with each other as in the case of the conventional method. It is sufficient that the phosphor layer be simply shielded from light. As described above, in the present invention, the light-shielding sheet is positioned at least on the surface on the phosphor layer side of the radiation image storage panel in a manner separable from said surface, whereby the exposure of the phosphor layer to natural light is restricted to an extent appropriate for practical use of the panel. Accordingly, the construction of the light-shielding means (i.e. the light-shielding sheet positioned on the surface on the phosphor layer side of the panel) employed in the present invention is markedly simpler than the construction of the light-shielding means (bag-like holder) used for the conventional combination of the X-ray photographic film with the intensifying screens.

In the present invention, the radiation image storage panel can be handled even in a light room and, therefore, it is very easy to handle. Further, the light-shielding sheet constituting the composite material for storage of a radiation image in accordance with the present invention is advantageous also for protecting the radiation image storage panel from dust, and can prevent the image quality from being deteriorated due to dust which sticks to the radiation image storage panel and interrupts or scatters the stimulating rays irradiated onto the panel or the light emitted from the panel when the panel is exposed to stimulating rays.

BRIEF DESCRIPTION OF THE DRAWINGS

FIGS. 1 to 4 are schematic views showing various embodiments of the composite material for storage of a radiation image in accordance with the present invention.

DESCRIPTION OF THE PREFERRED EMBODIMENTS

The present invention will hereinbelow be described in further detail with reference to the accompanying drawings FIGS. 1 and 2 show an embodiment of the composite material for storage of a radiation image in accordance with the present invention. In this embodiment, a light-shielding sheet 4 is provided on a protective film 1*c* of a rectangular radiation image storage panel 1 in a manner separable from the protective film 1*c*, and the surface of a phosphor layer 1*b* is shielded from light by the light-shielding sheet 4. The radiation image storage panel 1 comprises a light-shielding substrate 1*a*, the phosphor layer 1*b* provided on the substrate 1*a*, and the protective film 1*c* provided on the phosphor layer 1*b*. The light-shielding substrate 1*a* may be formed by using a light-shielding material as the substrate itself, or by applying or attaching a light-shielding material or a light-shielding sheet to the surface of a non-light shielding substrate, thereby imparting light-shielding property to the non-light shielding substrate. Of course, the light-shielding substrate 1*a* is not limited to such forms but may be in any form insofar as the substrate 1*a* is not permeable at least to the stimulating rays.

Between image recording and image read-out, the light-shielding sheet 4 is closely contacted with the protective film 1*c* as shown in FIG. 1 to prevent the surface of the phosphor layer 1*b* from being exposed to the stimulating rays. At the image read-out step, the light-shielding sheet 4 is separated from the protective film 1*c* of the panel 1 as shown in FIG. 2, and the surface of the phosphor layer 1*b* is exposed to the stimulating rays to read out the radiation image stored in the phosphor layer 1*b* . As shown in FIG. 2, the light-shielding sheet 4 of this embodiment is formed to cover a pair of the end faces of the rectangular radiation image storage panel 1 which are opposed to each other, thereby to shield these end faces from light. The light-shielding sheet 4 is completely secured to one of these end faces of the radiation image storage panel 1 so that the light-shielding sheet 4 cannot be completely separated from the radiation image storage panel 1. Separation of the light-shielding sheet 4 from the protective film 1*c* of the panel 1 at the image read-out step may be conducted automatically by catching the edge portion of the light-shielding sheet 4 which is not secured to the panel 1 by use of an arm provided in the read-out apparatus.

As described above, the light-shielding sheet 4 may be made of any material that interrupts the stimulating rays but is permeable to a radiation image. However, the light-shielding sheet 4 should preferably be flexible so that it can readily be separated from the radiation image storage panel 1. The pair of opposite end faces of the radiation image storage panel 1 not covered by the light-shielding sheet 4 should preferably be covered and shielded from light with an end face covering material having the light-shielding property. The light-shielding sheet 4 can also serve as a protective film. Therefore, in the composite material for storage of a radiation image shown in FIGS. 1 and 2, it is possible to omit the protective film 1*c* formed on the phosphor layer 1*b* of the radiation image storage panel 1.

FIG. 3 shows another embodiment of the composite material for storage of a radiation image in accordance with the present invention. In this embodiment, a flat plate-like light-shielding sheet 4 is positioned on the surface of the radiation image storage panel 1, i.e. on the protective film 1*c* thereof. The light-shielding sheet 4 is slightly adhered to the surface of the panel 1 by use of an adhesive (not shown) so that the light-shielding sheet 4 may not separate from the surface of the panel 1 in the course of the panel 1 being handled between the image recording and the image read-out, but can be separated from the surface of the panel 1 at the image read-out step. Further, the light-shielding sheet 4 has an area larger than the surface area of the panel 1 so that the light-shielding sheet 4 can be readily separated from the surface of the panel 1 at the image read-out step. In this embodiment, the light-shielding sheet 4 is completely separated from the panel 1 at the image read-out step. After the panel 1 is used again for recording a radiation image therein, the light-shielding sheet 4 which was separated from the panel 1 at the image read-out step as described above or a new light-shielding sheet 4 is again adhered to the surface of the panel 1.

In the embodiment described above, the end faces of the radiation image storage panel 1 should preferably be covered with a light-shielding end face covering material and shielded from light in order to prevent the stimulating rays from entering from the end faces.

FIG. 4 shows a further embodiment of the composite material for storage of a radiation image in accordance with the present invention. In this embodiment, the light-shielding sheet 4 is in the case-like form which simultaneously shields the surface and the end faces of the radiation image storage panel 1 from light. Namely, in this embodiment, the phosphor layer 1*b* is approximately completely shielded from light by the case-like light-shielding sheet 4.

When the composite material for storage of a radiation image in accordance with the present invention is used for a non-destructive inspection method for industrial products wherein X-rays of high energy are used, a sheet made of a heavy metal should preferably be used as the light-shielding sheet positioned on the surface on the phosphor layer side of the radiation image storage panel. This is because the sheet made of a heavy metal serves as a secondary electron generator and increases the sensitivity of the radiation image storage panel.

As described above, the radiation image storage panel constituting the composite material for storage of a radiation image in accordance with the present invention comprises a light-shielding substrate and a phosphor layer provided on the light-shielding substrate. As the stimulable phosphor dispersed in a binder to form the phosphor layer, any stimulable phosphor heretofore known for use in the radiation image storage panel can be used. The light-shielding substrate should preferably be made of a flexible material so that the radiation image storage panel comprising the flexible substrate can be bent according to the shape of the object. Further, a protective film for physically and chemically protecting the phosphor layer is usually provided on the phosphor layer on the side opposite to the substrate. Further, a prime-coating layer may be formed between the phosphor layer and the substrate for the purpose of increasing contact therebetween, or a light-reflecting layer may be formed between the phosphor layer and the substrate to improve the sensitivity of the panel. Or, a light-absorbing layer may be formed between the phosphor layer and the substrate to improve the sharpness of the image obtained by the panel. Further, to improve the sharpness of the image obtained by the panel, the phosphor layer may be colored, or white particles may be dispersed in the phosphor layer.

I claim:

1. A composite material for storage of a radiation image comprising: (i) a radiation image storage panel having a phosphor layer side, and comprising a light-shielding substrate and a phosphor layer containing a stimulable phosphor provided on said substrate, and (ii) a light-shielding sheet positioned on a surface on said phosphor layer side of said radiation image storage panel in a manner separable from said surface.

2. A composite material as defined in claim 1 wherein said light-shielding sheet covers at least a part of end faces of said radiation image storage panel, and shields said part from light.

3. A composite material as defined in claim 2 wherein said radiation image storage panel has a rectangular shape, said light-shielding sheet covers a pair of the end faces of said panel opposed to each other and shields said pair of the end faces from light, and said light-shielding sheet is secured to said panel at one of said pair of the end faces so that said light-shielding sheet is not completely seperable from said panel.

4. A composite material as defined in claim 3 wherein the pair of opposite end faces other than said pair of the end faces of said rectangular radiation image storage panel covered with said light-shielding sheet are provided with end face coverings made of a light-shielding material.

5. A composite material as defined in claim 1 wherein said light-shielding sheet is provided only on the surface on the phosphor layer side of said radiation image storage panel and adhered to said surface.

6. A composite material as defined in claim 5 wherein end faces of said radiation image storage panel are provided with end face coverings made of a light-shielding material.

* * * * *